United States Patent [19]

McDonough

[11] 4,194,193

[45] Mar. 18, 1980

[54] SELF-CONTAINED DOOR ALARM DEVICE

[76] Inventor: Larry McDonough, 529 E. Florence, West Covina, Calif. 91790

[21] Appl. No.: 854,646

[22] Filed: Nov. 25, 1977

[51] Int. Cl.[2] ..... G08B 13/08

[52] U.S. Cl. ..... 340/545; 200/61.62; 200/61.93

[58] Field of Search ..... 340/545, 546; 200/61.62, 61.93

[56] References Cited

U.S. PATENT DOCUMENTS 3,312,968 4/1967 Kiefer, Jr. ..... 340/545

*Primary Examiner*—Glen R. Swann, III

*Attorney, Agent, or Firm*—Boniard I. Brown

[57] ABSTRACT

A self-contained door alarm device is constructed with a housing, preferably fabricated from a high-strength insulator, such as ABS plastic, adapted to be secured above the upper edge of the door, to the doorframe. The alarm device contains a battery-operated tone generator operating in the audible frequency range, coupled to a small speaker. The power supply, preferably in the form of dry-cell batteries, is connected to the tone generator by a switch comprising a conductive strip mounted internally to the device housing, and provided with an elongated slot, and a conductive elastic spring anchored inside the housing and extending downwardly through the aforementioned slot to a position interfering with the plane of travel of the door upper edge. In the case of doors opening outwardly, the spring contact may be operated by a bracket attached to the door panel, along its upper edge. Movement of the spring contact due to entrainment by the door causes contact with the conductive strip and powers the tone generator, which in turn causes a tone to be emitted by the speaker.

12 Claims, 5 Drawing Figures

SELF-CONTAINED DOOR ALARM DEVICE

BACKGROUND OF THE INVENTION

The invention relates to door opening alarms. It relates, more particularly, to self-contained alarms powered by batteries and emitting a tone.

There are many instances: in retail establishments, small manufacturing shops, in restricted areas of larger commercial and industrial enterprises; where an audible warning of the opening of a door is required, or desirable. A typical case is a small retail or service shop open to the public in which the employees may be required to spend a substantial portion of the time away from direct view of the entrance door.

The prior art provides many different door alarms, operated mechanically, electrically and pneumatically, which fulfill the above-defined function. Such alarms may be set off by electrical switches integral with door mats, by electric eye—photoelectric—sensing units incorporated in the door frame, by means of pneumatic switches, or, simply consist of bells affixed to the door proper. All of these alarms of the prior art exhibit a common failing, that of being defeatable by a knowledgeable entrant, a would-be thief, for example, who desires to enter without being noticed.

Mat switches, of the electrical and pneumatic varieties, are readily overstepped; photoelectric sensors can be circumvented by avoiding interruption of the signal beam; mechanically coupled devices may be rendered ineffective by a very slow and deliberate operation of the door; electrical signals relying on connection to the building supply net may have their current supply interdicted by cutting a wire prior to entry.

It is, therefore, the primary object of the invention to provide a door alarm device which cannot be circumvented by an entrant to the protected space.

It is further object of the invention to provide for a secure door-opening alarm device which is self-contained and easily installed.

It is yet another object of the invention to provide features in a door alarm device which render it economical in construction and reliable in use.

it is also an object of the invention to provide a door alarm device equally adaptable to doors opening inwardly and/or outwardly on hinges, swing doors and rotary doors.

SUMMARY OF THE INVENTION

The above objects of the invention—and other objects and advantages which shall become apparent from the detailed description of the preferred embodiment thereof, below—are attained in a self-contained, battery-powered unit enclosed in a housing readily secured above the moving door panel in a doorway.

The enclosure is, preferably, constructed from an insulating material, and a wire-spring probe, of a conductive nature, depends from the housing. The probe is provided with a curved cam portion at its lowermost end, arranged to be entrained by the motion of the door toward the probe, or by a bracket attached to the door in case the latter opens away from the probe.

The probe is anchored at its upper end, within the enclosure housing, and passes through a slot in the lower face thereof. A conductive strip with a similar, but smaller, slot in it is affixed within the housing, with the slots in central alignment. The conductive strip and the probe are made parts of a switching circuit, so that the circuit is 'made' whenever a movement of the probe from its unstressed rest position, central in the slot of the conductive strip, takes place.

As the door opens, the cam portion of the probe is contacted by the upper edge of the door panel and is pressed rearwardly. At some point in the displacement of the probe the shank of the latter will contact the periphery of the slot in the conductive strip and an electrical circuit, powering a signal tone generator from the batteries within the housing, is established. The signal generator is, by preference, a solid-state electronic circuit resonant in the audio band and is connected to a small speaker mounted to the alarm enclosure. The exact frequency and harmonic content of the signal generator is so chosen that the speaker emits a characteristic, readily distinguished tone each time the probe/slot switch is actuated.

When the door opens outwardly, with respect to the protected position of the alarm unit, or if it so constructed that it may be opened in either direction, a wire bracket may be affixed to the door panel, forming an obstruction at the level of the upper edge of the door panel and encompassing the cam portion of the probe. In this manner an outward displacement of the door brings the bracket up against the probe cam, and results in the emission of a tone signal.

The use of batteries is made possible by the negligible current drain of the solid-state signal generator and renders the unit independent of an external, interruptible, supply. In cases where the door is opened so frequently that the periodic replacement of the batteries becomes a service problem, an externally powered battery charger may be provided, in conjunction with chargeable batteries. This combination still preserves the security of the local power supply to the tone generating system, since a severance of the charging cable will not render the unit inoperational and a thief succeeding in so disabling the external power input, and thinking himself safe from detection, will cause the alarm signal emission he sought to foreclose.

The wire probe can be mounted in any arbitrary proximity to the door so that the slightest motion of the latter will cause the operation of the alarm, or, in cases where this might be undesirable—for example a swing door exposed to wind loads which might move it slightly from its center position—may be placed at an offset with respect to the door panel. In any case the probe distance from the door, or operating bracket, should be so sized that no entry into the protected space is possible before the activation of the alarm.

The door alarm device of the invention requires no unusual or expensive constructional techniques in its manufacture, is inherently failsafe—in that any tampering with the operating probe is bound to result in electrical contact being established and the consequent emission of the alarm tone—and is maintenance-free, except for the occasional replacement of the batteries.

The alarm device may be secured to the door frame by means of screws, brackets, or, preferably, by means of adhesive strips secured to one face of the housing.

BRIEF DESCRIPTION OF THE ACCOMPANYING DRAWING

The preferred embodiment of the invention is described in detail with reference to the drawing, in which.

DESCRIPTION OF THE PREFERRED EMBODIMENT

Figure 1:
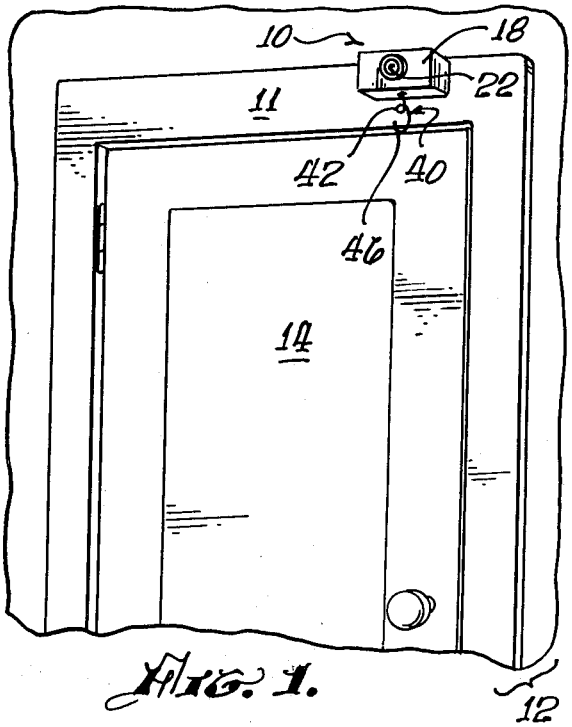
FIG. 1 is a perspective view of a doorway protected by an alarm device of the invention.

The perspective view of FIG. 1 illustrates the upper half of a doorway, including a doorframe 11 and a door panel 14, equipped with a door-opening alarm device 10 of the invention.

A wire probe 40, to be more fully described below, depends from the housing of the device 10 and intercepts the plane in which the upper edge of the door panel 14 moves in the course of an opening movement thereof. The probe 40 is adapted to be entrained by the motion of the door and to operate the alarm device.

Figure 2:
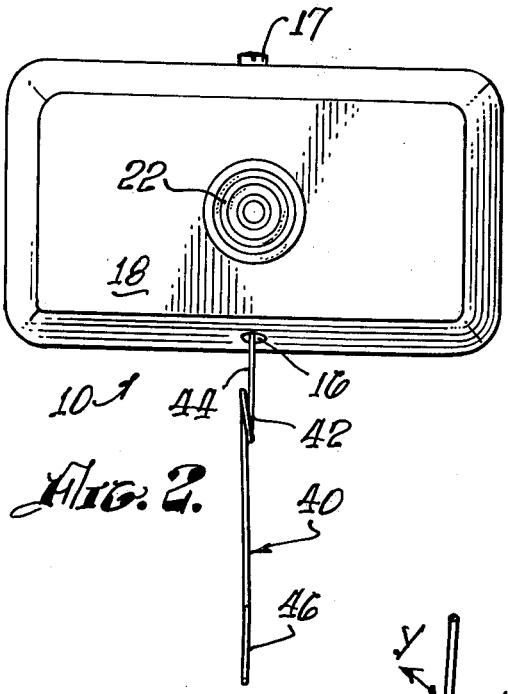
FIG. 2 is a frontal view of the alarm device housing and of the probe depending thereform.

FIG. 2 is a frontal view of the device 10, and of the probe 40, issuing from an orifice 16 in the base of an enclosure 18. The enclosure 18 projects the internal components of the alarm device and renders access to them impossible, save through deliberate disassembly. A speaker 22 is also visible in FIG. 2, mounted centrally in the housing 18.

Figure 3:
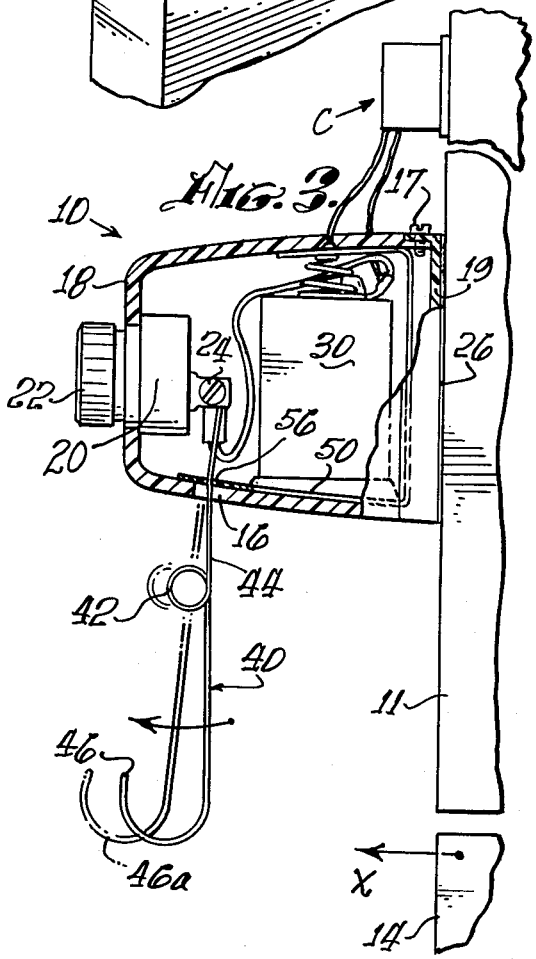
FIG. 3 is a transverse section through the embodiment of FIG. 2, mounted on a doorframe.

FIG. 3 is a transverse section of the alarm device 10, as mounted on doorframe 11 immediately above door 14. The housing 18 is seen to be attached, by means of a screw 17, to a backing plate 19. The backing plate 19 is provided with a flush, peripheral flange engaging the inner edge of the housing 18; it is secured to the door frame by means of adhesive strips. It should be noted that the backing plate 19 may be affixed to the doorframe 11 by any arbitrary and suitable means, such as screws, nails, clamps or brackets; as long as the attaching means can support the weight of the alarm device and resist the torsional loading placed on the probe 40 by engagement with the door panel 14.

The probe 40 is constructed from a wire with substantial elastic strength—steel, phosphor bronze or other conductive metal alloy—and is, preferably, circular in cross-section. Th probe includes a substantially linear shank portion 44, whose free end is anchored at an electrical contact 24, adjacent to a flexurally weak loop 42, a further linear shank segment, and a curved cam portion 46. The cam portion 46 is made re-entrant in transverse view—a semi-circular outline being suitable for the purpose—so that no free end is presented to any moving or stationary object which may snag on the exposed wire end.

In use, the door panel 14 is opened, with its upper edge travelling along a planar path represented by arrow 'X' in FIG. 3, and engages the probe 40 on its cam portion 46. The probe is forced backward by the displacement of the door—into a position represented by the dotted outline and indicated at 46*a*—thereby placing a cantilever loading on the probe. The shank portion 44 of the probe 40 is impelled into an angular displacement, deflecting at its anchor at contact 24, by the opening of the door and the entrainment of the cam 46.

The permitted angular displacement of the probe shank 44 is limited by the length of the elongated orifice 16 through which it issues from the housing 18, and even further limited by a similar orifice 56 in a conductor strip 50 superposed on the inner surface of the housing, in register with the orifice 16 therein.

The orifice 56 is smaller in all dimensions than the underlying orifice 16 and, consequently, any displacement of the probe shank, beyond a minimal clearance, results in contact being established between the two components. This contact is utilized in the manner of an electrical switch, to permit—and, on reversal, to interrupt—the flow of electric current from a battery 30 to tone generator 20.

The battery 30 is, typically, a normal dry cell, or combination of dry cells, adapted to drive the tone generator 20; the latter is, by preference, a solid-state electronic circuit resonant in the audio frequency band. It is open, of course, as a matter of design choice, to substitute some other noise-generating device—such as a clapper and bell—for the tone generator. In general, however, a solid-state tone generator, in conjunction with a small speaker, such as the speaker 22 incorporated in the device 10, is more efficient in terms of utilizing the limited energy of the battery 30 than any other device.

The tone generator 20 may take the form of an integral, commercially available resonator/speaker unit, such as is marketed under the "SONATOR" designation. In any case, the base frequency and the harmonic modulation of that frequency should be so selected as to provide a distinct signal, readily discriminated from background noise, such as may exist in a commercial or industrial environment.

Even with an efficient audible signal generating system, a door which is frequently opened will represent a substantial energy drain on the battery 30, and the latter may have to be replaced frequently enough to constitute a maintenance problem. In such circumstances the provision of of rechargable batteries may be considered, and a charging system connected to the common household supply provided. Such units, comprising basically a step-down transformer and a rectifying circuit, are commonly employed in conjunction with low-power electronic devices—calculators, photographic flashguns and their like—and are available at reasonable cost. Such chargers are frequently provided with bipolar connector jacks, readily accepted by sockets affixed in the peripheral wall of the housing 18. The provision and use of such charging devices does in no way detract from the security from tampering offered by the alarm device 10. A removal or interruption of the charging current simply transfers the electrical load to the battery integral with the unit, and allows it to function independently of the source of external electrical energy.

Figure 4:
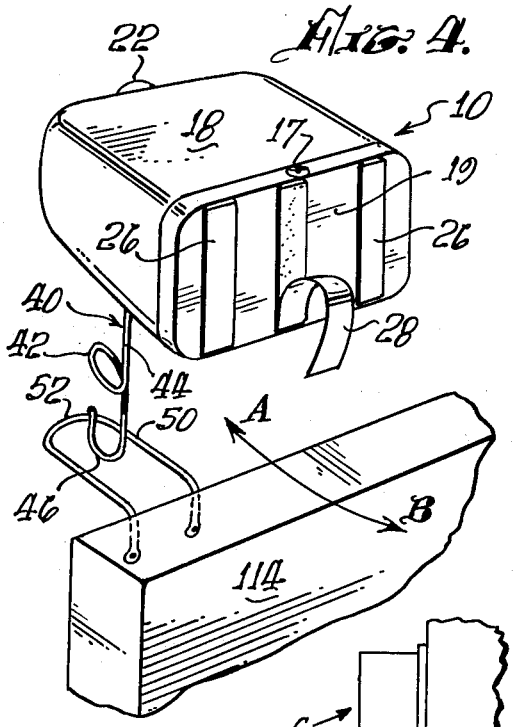
FIG. 4 is a perspective view of an alarm device adapted to operate from a swing door, with the aid of of bracket secured to the door panel.

Turning to FIG. 4 we see a perspective view of the alarm unit 10 from the normally hidden side, including the mounting plate 19. Also visible in this view are three adhesive strips 26, initially protected by treated paper or plastic covers 28, by means of which the unit 10 is affixed to the doorframe 11. Also visible in the same view is a door panel 114, of a swinging door. Such doors are frequently employed at the entrances to restaurant kitchens, and in store doorways where a customer may not readily adapt to a door opening in a fixed direction. The alarm device 10 can only be operated by the upper edge of the door 114 when it is opening inwardly, since the unit must be mounted inside the space to be protected by the device. To allow for possible door opening in the outward sense—in the direction of arrow "B" in the arcuate path "A-B" representing the potential operating arc of the door panel—a bracket 50 is provided, affixed to the upper edge of the inner face of the door 114. The bracket 50 represents a wire loop, or other geometric shape of sufficient rigidity, which has an inner portion 52 coplanar with the upper edge of the door and spaced inboard of the cam 46. While the actual spacing is not critical, the gap between the cam 46 and the actuating portion 52 of the bracket 50 is approximately equal to the gap between the cam and the inboard face of the door 114 for best results.

It should be noted that for revolving doors a bracket 50 or its analogues are not required, since a door leaf must pass any given point within the area swept by the door before anyone can be admitted to the interior of the entryway, so that the door leaves may serve to actuate the alarm device regardless of the sense of rotation.

Figure 5:
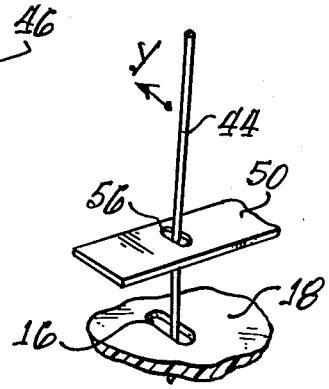
FIG. 5 is a fragmentary, perspective view of the electrical switch, incorporating the probe as one active element, in the door alarm device.

FIG. 5 is a fragmentary, perspective, partly exploded view of the probe shank 44 and the orifices 16 and 56 through which it passes to its anchor within the housing 18. For best operation the contact strip 50 should be made from a copper or aluminum alloy, for minimal electrical resistance, while the housing 18 is a non-conductor. A particularly suitable construction employs a housing 18 molded from a high-strength plastic—such as an ABS compound—which combines toughness with good insulating properties.

The door alarm device of the invention has been described above with reference to its preferred embodiment. Many changes in detail design may occur to one skilled in the art of constructing such devices, upon exposure to the teachings herein. Such changes shall be deemed to be encompassed by the invention, which is solely delimited by the appended claims.

Changes, in the sense of the remarks above, may affect the shape, configuration or material composition of the several parts; the nature of the sound-producing component therein; or the mechanical arrangement of the several parts. Typically, the probe 40 may be constructed from any arbitrary conductive material, including conducting plastics—as may be obtained by a high proportion of carbon black and/or copper dust in the molding compound—or may be constructed with a separate, conductive upper shank—in the region designated at 44 hereinabove—and a lower portion affixed thereto which is non-conductive. The probe may also be provided a cam portion formed differently from the semi-circular loop 46, or with a portion allowing for a reduced flexural stiffness in the operating direction, different from the loop 42. Such stiffness reduction may, for example, be attained by a repeated zig-zag shape in a lateral view corresponding to FIG. 3.

It is also foreseen that the enclosure 18, or a substitute therefor, may be constructed with a shape or internal cavity particularly adapted to serve as a resonator at the output frequency of the sound signal capacitor. Should such construction require that the enclosure be electrically conductive, the contact strip 50 can be spaced therefrom by means of an insulating interlayer, or an airspace.

What is claimed is:

1. A self-contained alarm device, adapted to provide an audible signal upon the opening of a door, comprising:

enclosure means comprising a mounting plate adapted to be secured to the door frame above said door, a DC power source, secured within said enclosure, an electrically powered sound signal source for said audible signal, adapted to be powered from said DC power source and connected thereto by means of an electrically conducting path, a switch in said conducting path adapted to interrupt current flow in said path with the door in a closed position, said switch comprising an electrically conductive planar element proximate to, and insulated from, the inner face of said enclosure at the basal surface thereof, coaxial orifices in said conductive element and said basal surface, with the orifice in the latter increased in size with respect to the orifice in the former, a cantilevered conductor depending from a fixed anchor within said enclosure and passing through said orifices in an alignment spaced from the peripheries thereof in an unloaded state, and actuator means for said switch responsive to movement of said door toward an open position, and comprising cam means affixed to said cantilevered conductor, further depending from said enclosure and adapted to be entrained by said door upon the movement thereof toward said cam into said open position, wherein one leg of said conductive path is terminated at said conductive element and one leg is terminated at said anchor, thereby allowing current flow in said path when said cam means is entrained by the door and said cantilevered conductor is deflected against the perimeter of said orifice in said conductive element.

2. The self-contained alarm device of claim 1, wherein said cantilevered conductor and said cam means are constructed from an elongated, wire-like conductor, and wherein said cam means include a curvilinear, re-entrant segment in a plane substantially orthogonal to the inner face of said door.

3. The self-contained alarm device of claim 2, wherein a stress-relieving, flexurally weak, intermediate portion is interposed along said wire-like conductor between said cantilevered conductor and said cam means.

4. The self-contained alarm device of claim 3, wherein said intermediate portion is in the form of a re-entrant, circular loop tangent to said cantilevered conductor.

5. The self-contained alarm device of claim 1, wherein said DC power source includes a battery.

6. The self-contained alarm device of claim 5, wherein said battery is a dry cell.

7. The self-contained alarm device of claim 6, wherein said dry cell is rechargeable, and said DC power source further includes a charger therefor.

8. The self-contained alarm device of claim 1, further comprising: cam-operator bracket means, adapted to be affixed to said door, encompassing said cam means, whereby a departure of said door from the closed position, in a direction directed away from said cam means, causes said cam means to be entrained by said bracket means, and to deflect said cantilevered conductor into contact with said orifice in said conductive element.

9. As an article of commerce, a self-contained alarm device, adapted to provide an audible signal upon the departure of a door panel from a normally closed position, comprising:

an enclosure, including a mounting plate adapted to be secured to the door frame above said door, a DC power source comprised of batteries housed within said enclosure, an electrically powered sound signal source for said audible signal affixed to said enclosure and adapted to be powered from said DC source, conductor means, including normally open switch means, interconnecting said DC source with said sound signal source, actuator means for said switch means, responsive to the motion of said door toward an open position, and bracket means, affixable to said door panel, proximate to the upper edge thereof, encompassing said actuator means between said door panel and a lateral segment of said bracket means.

10. The article of commerce of claim 9, further comprising: charger means for said batteries.

11. The article of commerce of claim 10, wherein said batteries are comprised of at least one rechargeable dry cell.

12. The article of commerce of claim 9, wherein said batteries include at least one dry cell.

* * * * *